United States Patent [19]

Hunt et al.

[11] Patent Number: 4,688,731

[45] Date of Patent: Aug. 25, 1987

[54] MEANS FOR SECURING CUTTING OR BREAKER ELEMENTS TO A ROTATABLE MEMBER

[75] Inventors: Noel Hunt; Michael J. F. Secretan, both of Ravenshead, England

[73] Assignee: Ansec Design and Engineering Limited, Hucknall, England

[21] Appl. No.: 785,480

[22] Filed: Oct. 8, 1985

[30] Foreign Application Priority Data

Mar. 27, 1985 [GB] United Kingdom ..... 85.07989

[51] Int. Cl.[4] ..... B02C 13/26; B02C 13/28

[52] U.S. Cl. ..... 241/191; 241/292.1; 241/294

[58] Field of Search ..... 241/188 R, 189 R, 191, 241/192, 292.1, 294; 29/526 R

[56] References Cited

U.S. PATENT DOCUMENTS 2,543,599 2/1951 Rietz ..... 241/191 X
3,220,658 11/1965 Shelton, Jr. ..... 241/191 X
4,056,232 11/1977 Linnerz et al. ..... 241/194

*Primary Examiner*—Timothy V. Eley
*Attorney, Agent, or Firm*—Balogh, Osann, Kramer, Dvorak, Genova & Traub

[57] ABSTRACT

A mineral breaker is disclosed having a rotary central shaft upon which a plurality of collars (10) are non-rotatably secured. Each collar has a first pick support ring (13) secured at each of its ends with two second pick support rings (19) slidable on the collar between the first support rings. Each pair of first and second support rings defines between them a plurality of separate locations for picks (35). An infill ring (28) formed in two halves is fitted on the collar between the two second support rings (19) and forces the rings (19) against the picks to secure them tightly in position. A pair of threaded bolts secure the two halves of the infill ring together and also allow quick and easy release of the halves, and thus removal from the collar to allow the rings (19) to be slid from the picks, when pick replacement is required.

8 Claims, 10 Drawing Figures

MEANS FOR SECURING CUTTING OR BREAKER ELEMENTS TO A ROTATABLE MEMBER

This invention relates to means for securing cutting or breaker elements to a rotatable member, and in particular to means for securing such elements to an annular part of a mineral breaker.

The object of the invention is to provide means which enable the cutting or breaker elements to be secured to and removed from the rotatable member quickly and easily, so that replacement of broken elements is facilitated.

According to the invention there is provided means for securing a cutting or breaker element to a rotatable member, comprising a rotatable member, a first cutting or breaker element support secured to or securable to the rotatable member to rotate therewith and extending from a surface of the rotatable member, said first support having at least one surface against which part of a cutting or breaker element is intended to abut, in use, and a second cutting or breaker element support having at least one surface adapted to be held against another part of the cutting or breaker element and thereby releasably to retain said cutting or breaker element between said support members so that it rotates with said rotatable member, in use.

Preferably the first support is a ring secured to the circular periphery of an annular part and the second support is a clamp ring axially slidable on said annular part, said fixed ring having a plurality of radially extending slots therein to define the locations of a plurality of cutting or breaker elements respectively, the arrangement being such that in use a cutting or breaker element is engaged in one of said slots against a mating or substantially mating surface of said fixed ring, and said clamp ring is slid axially into mating or substantially mating engagement with said cutting or breaker element and is held in such engagement to retain the cutting or breaker element in place on the annular part.

Conveniently there are two rings secured to the annular part at respective opposite ends thereof, against which, in use, cutting or breaker elements are clamped by two of said clamp rings respectively, with a releasable infill ring being tightly engaged between the two clamp rings, to secure the elements to the annular part.

Desirably the annular part is an annular collar of a mineral breaker, the breaker being made up of a rotatably driven shaft on which a plurality of said collars are keyed.

The invention will now be described, by way of example, with reference to the accompanying drawings, in which.

The present invention has particular relevance to the securing of cutting or breaker elements, hereinafter referred to generically as picks, to an annular collar of a mineral breaker. The breaker is formed by a central rotatably driven shaft upon which a plurality of such collars are non-rotatably secured by keyways.

Figure 2:
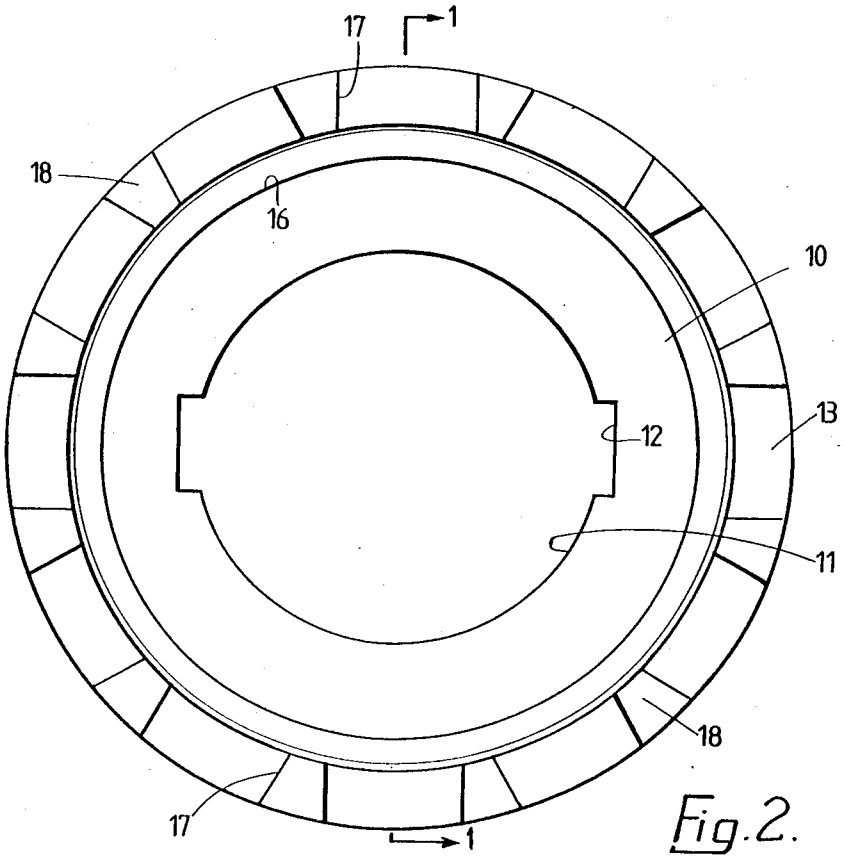
FIG. 2 is a view of one end of the collar, with the cutting or breaker element and a clamp ring of FIG. 1 removed.
Figure 1:
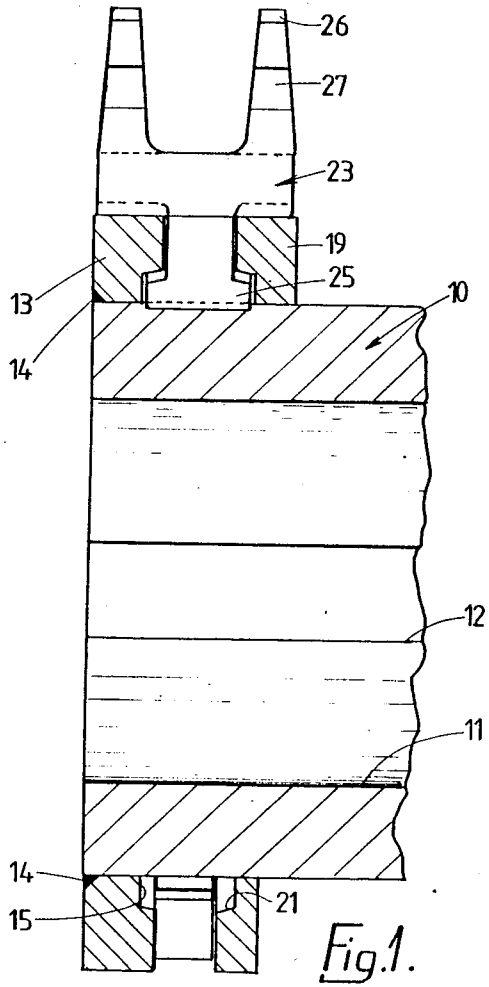
FIG. 1 is a fragmentary diametral sectional view of a mineral breaker collar, the section being taken on the line 1—1 of FIG. 2, with one cutting or breaker element shown secured to the collar adjacent its one end.

FIGS. 1 and 2 show one of said annular collars 10. It can be seen that the collar has a central cylindrical bore 11 which has a pair of diametrically opposite rectangular slots 12 so that it can be keyed to the rotatable shaft of the mineral breaker. Around its circular periphery at one of its ends there is secured a circular ring 13. At its outer side the ring is generally flat, though at the junction of this flat surface with the peripheral surface of the collar, the ring is slightly recessed where it is welded to the collar as shown at 14 in FIG. 1.

At its opposite side, the ring 13 is cut-away both radially and axially. Radially a cut extends outwardly from the internal cylindrical surface of the ring for about one third of the height of the ring. The cut 15 is then continued in a direction away from the flat face of the ring, and for a short distance at a slight angle away from the cylindrical collar surface, before it extends axially to the other face of the ring. There is thus provided a continuous annular groove 16 between the ring and the outer peripheral surface of the collar 10.

The ring 13 is further provided with twelve equiangularly spaced slots 17. Each slot extends generally radially inwardly from the outer peripheral surface of the ring 13 and communicates with the groove 15. Each slot extends axially inwardly from the same side of the ring as the open side of the groove 16. However, the axial inward extent of each slot is slightly less than that of the groove 15, as can be seen from FIG. 1, with the slot terminating at the outer end of the short, slightly angled surface of the cut 15.

Each slot has flat, parallel sides, in the axial direction, as shown in FIG. 2, and between adjacent sides of adjoining slots are formed lands 18.

Each of the slots 17 is provided as a location for a pick. Once the picks are in position in engagement with the ring 13, a clamp ring 19 (FIG. 3) slidably engaged on the collar 10 is axially slid into engagement with the picks and then held securely in position as will be described.

Figure 3:
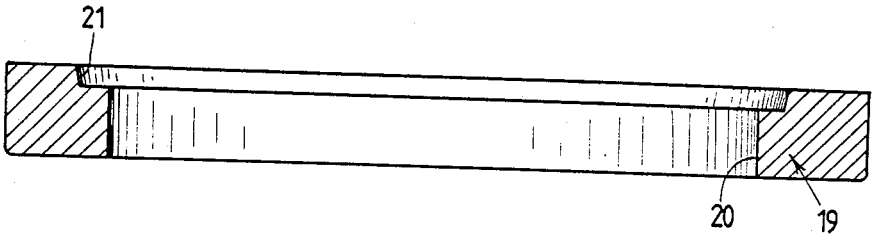
FIG. 3 is a diametral sectional view of a clamp ring shown in FIG. 1.

The ring 19 shown in FIG. 3 is considerably narrower than the ring 13, but has the same external diameter. The interior surface of the ring 19 is stepped, there being a first bore 20 matching the external diameter of the collar 10 so that the ring 19 can just slide on the outer peripheral surface of the collar 10. This first bore is then stepped outwardly to provide a larger second bore 21 which is tapered axially outwardly to match the part of the cut 15 of the ring 13 which is inward of the slots 17.

Figure 4:
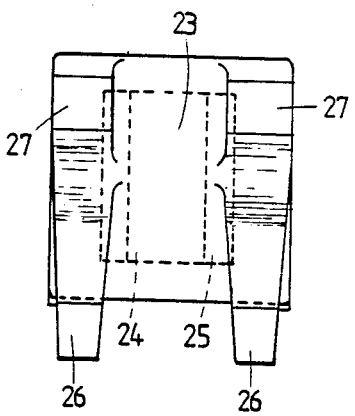
FIGS. 4 to 6 are front, side and plan views respectively of a cutting or breaker element in the form of a pick, as shown in FIG. 1.
Figure 5:
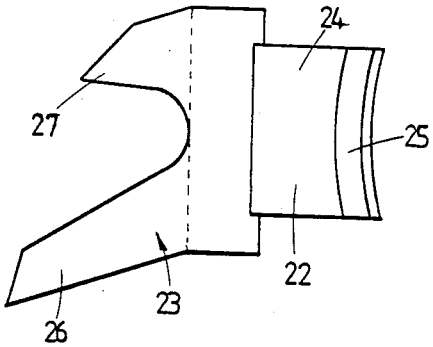
Figure 6:
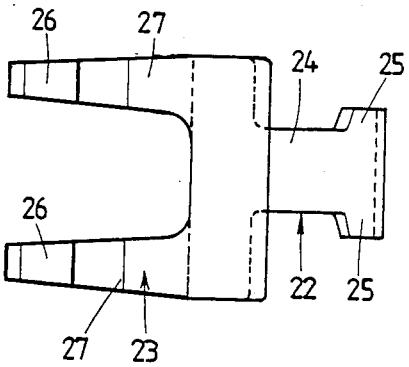

FIGS. 1 and 4 to 6 show a form of pick intended for use with a collar 10 and ring 19 of this embodiment of the invention. The pick has a shank portion 22 and a head portion 23. The shank portion comprises a rectangular part 24, at the end of which remote from the head portion is provided a base part which extends axially outwardly of the rectangular part, as shown in FIG. 6, to provide a pair of lugs 25. Each lug extends along the whole of the side of the rectangular part 24, as shown in FIG. 5 and the under surfaces of the respective lugs and the under surface of the base part are curved to match the curvature of the outer peripheral surface of the collar 10. The length of the rectangular part 24, and thus also of the lugs is equal to the width of a slot 17, this being the width shown in FIG. 2 between the opposing flat sides of a slot. From this it will be appreciated that the end surfaces of the rectangular part 24 are flat and parallel. The upper surfaces of the lugs 25 are concave to match the curvature of the upper surface of the groove 15 and the curvature of the bore 21 for the two lugs respectively. The height of the rectangular part 24 corresponds to the height of a land 18.

The head part 23 is of generally rectangular form and is both longer and wider than the rectangular part 24, as can be seen particularly from FIGS. 4 to 6. Especially in FIG. 5 it can be seen that the head portion 23 is longer than the rectangular part 24, whilst from FIG. 6 it can be seen that the head portion 23 is considerably wider. The under surface of the head portion 23 is concave to match the curvature of the outer peripheral surfaces of the rings 13 and 19, the curvature of the under surface of the head portion 23 being at opposite sides of the rectangular portion 24.

The pick is provided with a pair of front teeth 26 and a pair of rear teeth 27. In the example of pick illustrated the rear teeth are disposed adjacent opposite ends of one of the shorter sides of the generally rectangular head portion, whilst the front teeth are longer and extend forwardly over the opposite shorter side. Although the use of a quadruple pick can be desirable, the actual form of the upper part of the head portion does not form part of the present invention so that any convenient alternative form can be used.

Figure 8:
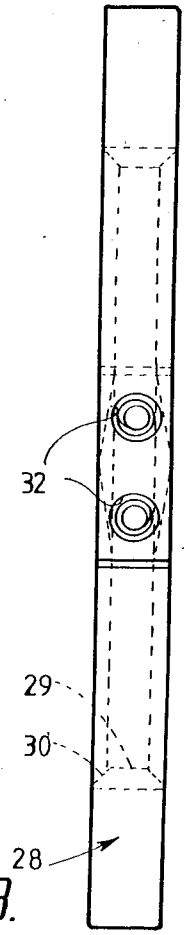
FIG. 8 is an end view of the infill ring.
Figure 7:
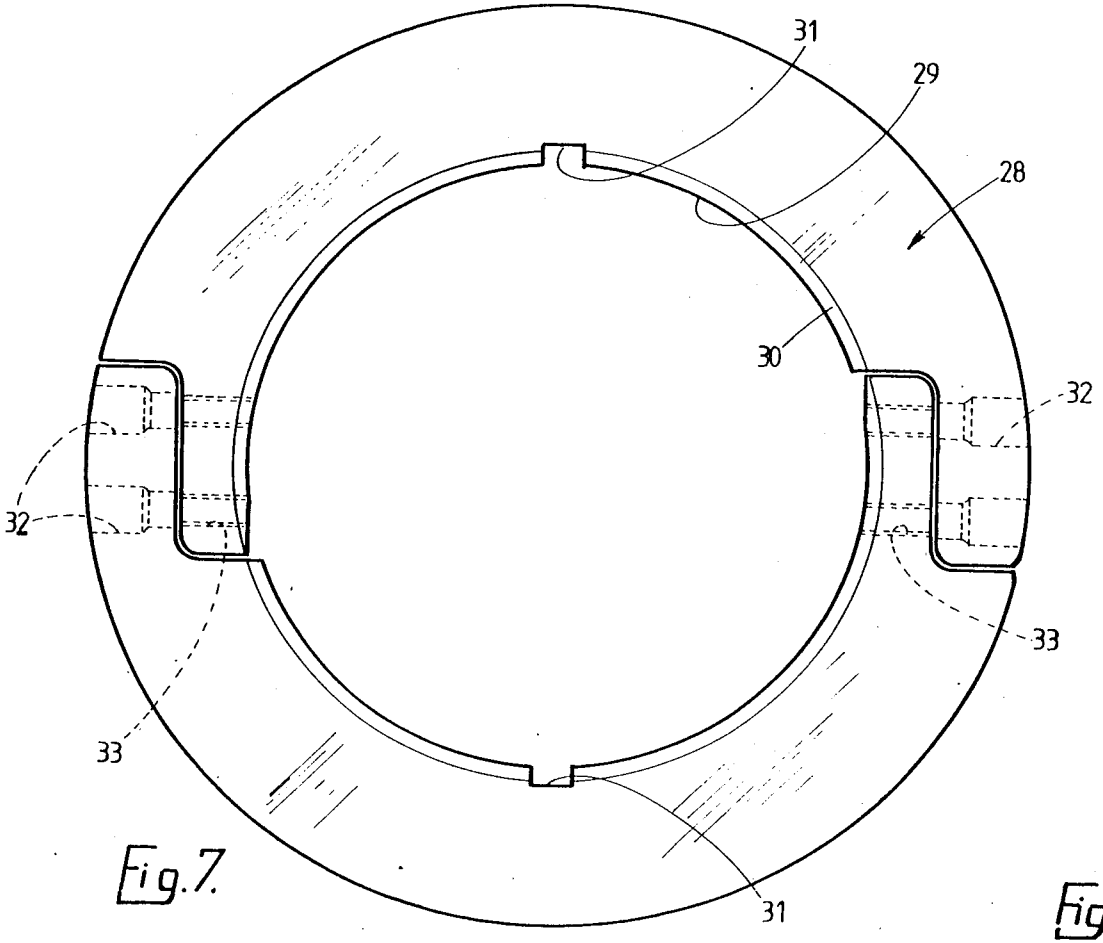
FIG. 7 shows an infill ring for insertion between a pair of clamp rings on the collar.

FIGS. 7 and 8 show an infill ring 28 having an internal bore 29 of a diameter such that the ring will fit tightly on a collar 10. Both sides of the internal bore are tapered as at 30 to increase the diameter thereof. The internal surface of the bore has opposite radial recesses 31 for a purpose to be described.

The ring 28 is divided into two halves by a pair of cuts, each extending from an outer surface of the ring to the bore 29. Each cut is of generally Z-shape so that at each cut the ring halves have respective abutting fingers.

The outermost finger of each half ring has a pair of stepped bores 32 therethrough disposed perpendicularly to the respective flat abutting surfaces of the halves. The innermost finger of each half has respective aligned threaded bores 33 therein, so that a bolt can be received in each bore 32 with its threaded shank extending into an aligned bore 33. The bolts can then be screwed up to draw the two halves together to form a tight, complete ring. In this way the infill ring can be tightened up to engage on a collar 10, with a peg 34 (FIG. 10) on the collar engaging in one of the recesses 31 to prevent rotation of the ring 28 relative to the collar 10.

Figure 9:
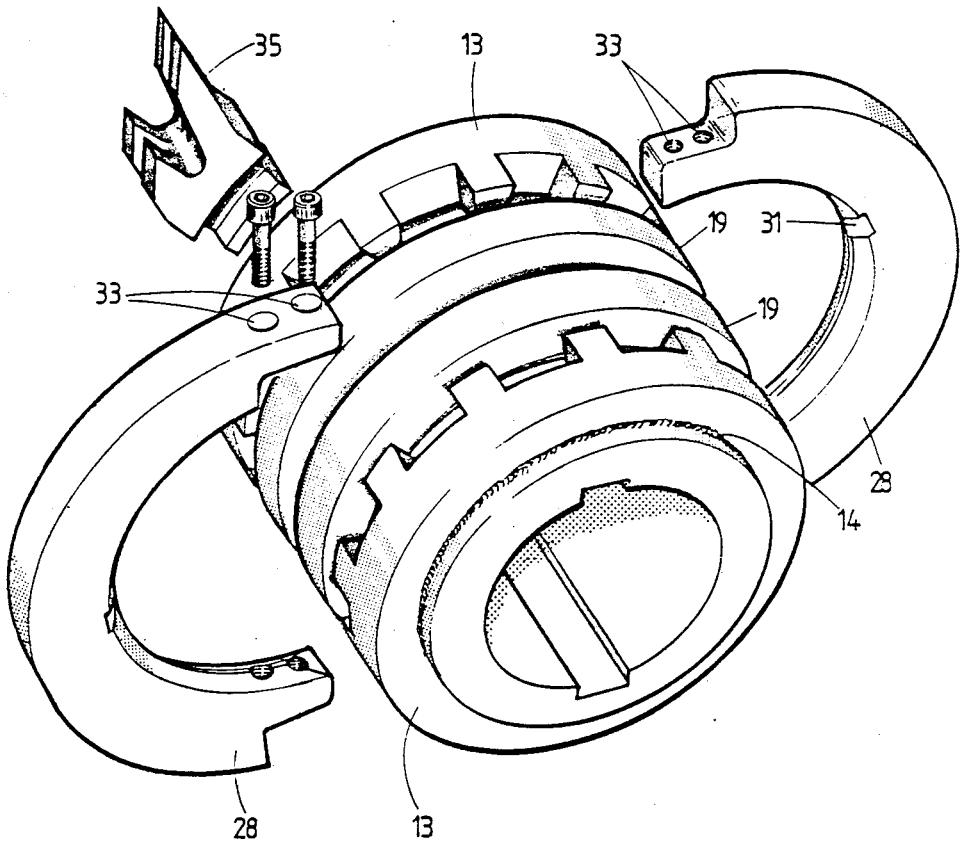
FIG. 9 is an exploded view of how a pick is engaged on a mineral breaker collar.

FIG. 9 shows the arrangement of components on a single collar 10. At one end a ring 13 is secured to the collar as described and shown in FIG. 1. A pair of clamp rings 19 are then slid onto the collar from its opposite end, the first ring 19 having its larger bore 21 facing towards the ring 13 and the second ring 19 having its larger bore 21 facing away from the first ring 19. Finally another ring 13 is secured to said opposite end of the collar with its slots 17 facing the second ring 19. Picks 35 are engaged in respective slots 17 of either or both rings 13 and the rings are slid towards their respective associated rings 13 until they contact the picks. In this position the space between the rings 19 is just sufficient for the reception of an infill ring 28. The two halves are inserted between the rings 19 and screwed tightly together by means of a pair of bolts in the bores 32, 33. The infill ring forces the rings tightly against the picks thereby securely holding them in place between the rings 13 and 19. The peg 34 engages in a recess 31 to prevent rotation of the infill ring 28.

Figure 10:
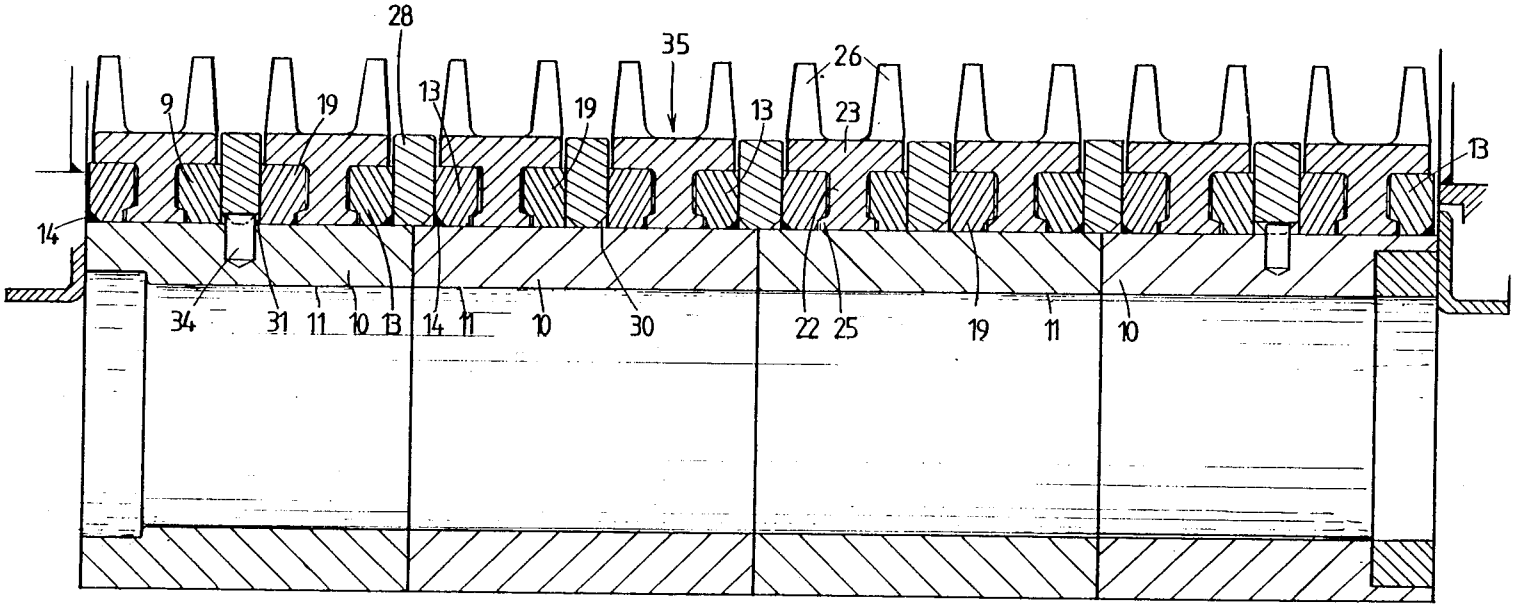
FIG. 10 is a diametral sectional view of four mineral breaker collars on a driven shaft, with picks secured on each collar.

FIG. 10 shows part of a mineral breaker where four collars 10 are keyed to a rotatable shaft (not shown), with each collar having the arrangement as described with respect to FIG. 9, namely twelve picks held between rings 13 and 19, giving twenty four picks per collar. With this arrangement of four collars, the rings 13, except the two extreme end rings, are welded to a collar slightly inwardly of its end, so that an infill ring 28 is located over the junction of two adjacent collars and between a pair of rings 13. This infill ring between adjacent collars is provided to maintain the level along the collars and prevent oversized material avoiding the picks and passing between adjacent rings on adjacent collars.

It will be appreciated that if it is required to replace a pick, for example if it is worn or damaged, it is merely necessary to undo the bolts securing the two halves of the infill ring on the collar carrying the damaged pick. Removal of the infill ring enables the ring 19 engaging the pick to be slid axially on the collar to a position clear of the pick, which can then also be axially slid out from its slot 17, and removed. Replacement is simply the reverse process. Thus the other collars on the mineral breaker shaft remain undisturbed.

Instead of providing infill rings to prevent axial movement of a clamp ring 19, it is possible to provide a threaded bore in one of a ring 13 and its associated clamp ring 19, and an aligned bore, which could be threaded, in the other of the ring 13 and its associated clamp ring. Thus by screwing a threaded bolt into the threaded bore through the other bore the two rings could be releasably secured together. Conveniently the lands 18 of the ring 13 could contain drilled holes, and the ring 19 could contain aligned threaded bore. Threaded bolts could then be inserted in the holes in the lands and screwed into the bores in the ring. This would clamp a ring 13 and a ring 19 and secure the picks tightly between them. Nuts can be engaged on the ends of the bolts if required.

Assembly and use of the various components will now be described.

As will be appreciated, the shank portion 22 and the lower part of the head portion 23 of each pick is dimensioned and shaped to engage or substantially engage with various surfaces of the collar 10, fixed ring 13, and clamp ring 19. Accordingly to assemble the picks on the collar 10, the shank portion 22 of each pick is engaged in a respective one of the slots 17. In this position of engagement the curved under surfaces of the lugs 25 and the base part of the rectangular part 24 engage upon the correspondingly curved outer peripheral surface of the collar 10. The side of the left-hand lug 25, as viewed in FIG. 1, does not quite engage against the radial surface of the groove 16, there being a slight clearance therebetween. However the curved upper surface of this lug 25 is in contact with the correspondingly angled side surface of the groove 16. There is also a slight clearance between the flat side surface of the rectangular part 24 of the pick and the side surface of the slot 17, which is correspondingly flat. The curved under surface of the head portion 23 can engage on the correspondingly curved outer peripheral surface of the ring 13, as shown, or could be slightly spaced therefrom. The flat end surfaces of the part 24 engage the flat sides of the slot 17. Force on the pick is thus transmitted at the upper surfaces of the lugs to the rings.

To secure each of the picks in this position, the clamp ring 19 is slid along the collar 10 until it engages against the opposite side of the pick from the ring 13, as shown in FIG. 1. The engagement of the pick with the ring 19 is similar to that described with respect to the ring 13, namely that the other lug 25 engages in the part of the bore 21 formed by the step whilst the opposite side surface of the rectangular part 24 is disposed slightly spaced from the adjacent flat side of the ring 19. Lastly the under surface of the head portion 23 of the pick at the other side of the rectangular part 24 engages upon or is slightly spaced from the correspondingly curved outer peripheral portion of the ring 19. Load shearing thus takes place, in use, in the ring 13 from the leading pick to the trailing pick in the direction of rotation and breaking. Load distortion is absorbed and transmitted through the rings.

As mentioned the form of teeth on the picks can be varied as required. Moreover the collar 10 and rings 13 and 19 need not be circular as described. Moreover instead of a continuous ring being used to define the locations of the picks, a plurality of discrete and unconnected locations could be used.

We claim:

1. Means for securing a pick to a rotatable member, comprising a rotatable member, said rotatable member having a circular outer peripheral surface, a first pick support, said first pick support being an annular element on the circular outer peripheral surface of said rotatable member and extending therefrom, said first pick support having an axially directed face, a plurality of radial slots being provided in said face, a continuous annular groove, said groove being disposed laterally of said slots and communicating therewith, said slots being open at their outer radial ends respectively, a second pick support on said rotatable member, one of the first and second pick supports being secured against rotation relative to the rotatable member, the other of the first and second pick supports being slidable on the rotatable member, said second pick support having a surface adapted to be held against a part of the pick, while another part of which is received in one of said slots and said groove, thereby releasably to retain the pick between said first and second supports.

2. Means according to claim 1, wherein said continuous groove has a radially inner end, the radially inner end of said groove being closed by the circular peripheral surface of said rotatable member, and said slots have respective radially inner ends, said continuous groove communicating with said slots at the respective radially inner ends thereof respectively.

3. Means according to claim 2, wherein said second pick support has an axially directed face when on said rotatable member, a continuous annular groove being provided in the axially directed face of said second pick support, and having an inner end closed by the circular peripheral surface of said rotatable member, the continuous annular grooves in the first and second supports respectively being adapted to receive first and second laterally extending base lugs on the pick, with a shank of the pick being received between the axially directed faces of the first and second supports, wherein said first pick support is secured against rotation relative to the rotatable member and the second pick support is slidable on said rotatable member.

4. Means according to claim 3, comprising two of said first supports secured on said rotatable member in an axially spaced, parallel relationship, said respective axially directed faces thereof which have said slots therein facing each other, two of said second supports on said rotatable member between the two first supports, said grooves of said second supports facing said first supports respectively, a releasable infill ring between the two second supports, said infill ring being tightly engaged between the two second supports, in use, to hold them against picks between each pair of first and second supports respectively, so as releasably to secure the picks to the rotatable member.

5. Means according to claim 4, wherein the infill ring is formed in two halves, the halves being releasably securable together for engagement on or disengagement from said rotatable member.

6. Means according to claim 5, comprising a pair of threaded bolts, and means defining aligned bores at the respective ends of the halves, the two halves being securable together by engagement of said bolts in said bores.

7. Means according to claim 4, comprising a peg extending outwardly from the surface of the rotatable member, an internal surface of the infill ring, and means defining a recess in said internal surface of the infill ring, the peg engaging in said recess to secure the infill ring against rotation on the rotatable member.

8. Means according to claim 4, comprising a plurality of said rotatable members, each rotatable member having opposite ends, said two first supports on each rotatable member being secured at said opposite ends respectively, said plurality of rotatable members being arranged in a row for engagement, in use, on a rotatable shaft, respective junctions between the plurality of rotatable members, additional infill rings, said additional infill rings being for engagement on the rotatable members between adjacent first supports at said junctions of the rotatable members.

* * * * *